US005206106A

United States Patent [19]

Moriya

[11] Patent Number: 5,206,106

[45] Date of Patent: Apr. 27, 1993

[54] CONDUCTIVE MAGNETIC TONER

[75] Inventor: Yuichi Moriya, Shizuoka, Japan

[73] Assignee: Tomoegawa Paper Co., Ltd., Tokyo, Japan

[21] Appl. No.: 791,287

[22] Filed: Nov. 13, 1991

[30] Foreign Application Priority Data

Nov. 14, 1990 [JP] Japan ..... 2-306122

[51] Int. Cl.[5] ..... G03G 9/083

[52] U.S. Cl. ..... 430/106.6; 430/111; 430/903

[58] Field of Search ..... 430/106.6, 111, 903

[56] References Cited

U.S. PATENT DOCUMENTS 4,514,485 4/1985 Ushiyama et al. ..... 430/111 X 4,877,707 10/1989 Grushkin et al. ..... 430/903 X

FOREIGN PATENT DOCUMENTS 257763 10/1988 Japan ..... 430/106.6

1539080 1/1979 United Kingdom ..... 430/903

*Primary Examiner*—Roland Martin

*Attorney, Agent, or Firm*—Finnegan, Henderson, Farabow, Garrett and Dunner

[57] ABSTRACT

A conductive magnetic toner including a magnetic powder having a specific resistance of not more than $1\times10^6$ Ω.cm in the amount of from 40% by weight to 60% by weight and a carbon black having a specific surface area of 800 $m^2/g$ to 1500 $m^2/g$ and an oil absorption of dibutyl phthalate of not less than 200 cc/100 g in the amount of from 8% by weight to 15% by weight is provided.

10 Claims, 1 Drawing Sheet

CONDUCTIVE MAGNETIC TONER

BACKGROUND OF THE INVENTION

1. Field of the Invention

The present invention relates to a toner for developing electrostatically charged images in an electrophotographic method, an electrostatic-printing recording method, and the like. More particularly, it relates to a conductive magnetic toner for use in a conductive developing method.

2. Prior Art

In general, an electrophotographic method comprises the steps of: (1) forming an electric latent image on a photoconductor; (2) developing the latent image with toners to form a toner image; (3) optionally transferring the toner image to a paper; and (4) fixing the toner image by means of heating, pressurization, and the like to obtain a copy. Classes of developers for use in such electrophotographic methods include two-component developers consisting of a toner and a carrier, and single-component developers consisting of only a toner which also functions as a carrier.

The single-component developers have two main classes. One is a magnetic single-component developer, and the other is a non-magnetic single-component developer. The magnetic single-component developer includes magnetic powder in the amount of approximately from 10% by weight to 70% by weight. In addition, the magnetic toners are roughly divided into conductive magnetic toners and insulating magnetic toners. The driving force of the conductive magnetic toner is an electrostatic induction or an electric charge. On the other hand, the driving force of the insulating magnetic toner is an electric charge by means of triboelectrification.

It has been known that the magnetic single-component development using the conductive magnetic toner has advantages in that there is no need to control the toner density and that the uniform image density without edge effect can be obtained. In addition, if the conductive magnetic toner has the specific resistance of generally not more than $10^4$ Ω.cm, the magnetic toner can be advantageously used in a system having an electric potential of not more than 200 V.

On the other hand, the conductive magnetic toner has disadvantages in that the toner is liable to leak the charges thereof via the transfer paper during the electrostatic transfer, for which reason, it is difficult to transfer the image to the plain paper. In addition, if large amounts of carbon blacks are added to the magnetic toner so as to provide conductive properties to the magnetic toner, it is disadvantageously difficult for the toner to be thermally fixed.

Although in order to dissolve the transfer problem described above, the special papers wherein the high-resistance treatment has been carried out, or the pressure transfer method can be employed, the thermal fixing properties are not adequate. Therefore, in the conventional art, both low resistance and good fixing properties cannot be obtained simultaneously.

In order to obtain both the desired low-resistance and fixing properties, it has been proposed that large amounts of carbon black are added to the surfaces of the high-resistant toner particles having the specific resistance of about from $10^6$ Ω.cm to $10^9$ Ω.cm, or that the conductive carbon blacks are fixed to the surfaces of the same toner particles as described above by means of impulse force. When the proposals described above are applied to the conductive toners, the seemingly specific resistance is lowered. However, in fact, the internal resistance of the magnetic toner is not so lowered. For this reason, conductive parts are not sufficiently formed in the developing step and the electric charges are not adequately poured. In particular, in the low developing-potential system, there are disadvantages such as reduction of the image density, increase in the fog density, and the like.

SUMMARY OF THE INVENTION

In order to solve the problems described above, it is an object of the present invention is to provide a conductive magnetic toner wherein a superior image having a high-quality image density and little fog density can be obtained even in a low-developing-potential system by virtue of lowering the resistance of the conductive magnetic toner with retaining fixing.

Therefore, one aspect of the present invention is directed to providing a conductive magnetic toner including (a) a magnetic powder having an specific resistance of not more than $10^6$ Ω.cm in the amount of 40% by weight through 60% by weight and (b) a carbon black having a specific surface area of 800 $m^2/g$ to 1500 $m^2/g$ and an oil absorption of dibutyl phthalate (hereafter, it is abbreviated to as "DBP oil absorption") of not less than 200 cc/100 g, in the amount of 8% by weight to 15% by weight.

The above objects, effects, features, and advantages of the present invention will become more apparent from the following description of preferred embodiments thereof.

DETAILED DESCRIPTION OF THE INVENTION

Figure 1:
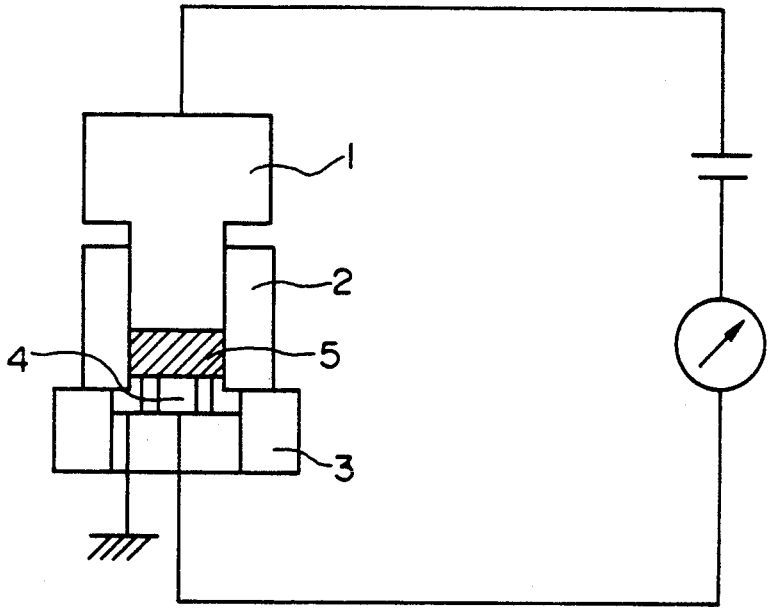
FIG. 1 is schematic view of an apparatus for measuring the specific resistance of the magnetic powder.

According to the present invention, a conductive magnetic toner is provided which includes (a) a magnetic powder having an specific resistance of not more than $10^6$ Ω.cm in the amount of 40% by weight through 60% by weight and (b) a carbon black having a specific surface area of 800 $m^2/g$ through 1500 $m^2/g$ and a DBP oil absorption of not less than 200 cc/100 g in the amount of 8% by weight to 15% by weight.

In the case where the carbon black having the specific surface area and the DBP oil absorption described above is included in a toner, it is liable to form a conductive part in the toner since the carbon black has a small particle size and a chain structure of the mutual particles, which is so-called "structure", is dense. However, when such carbon black is dispersed into a binder resin, the dispersion becomes viscous and the thermal-fixing properties are impaired. For this reason, the blending ratio of the carbon black to the toner is limited so as to obtain the satisfied thermal fixing properties.

Therefore, according to the present invention, it makes possible for the conductive magnetic toner to have the lowered internal resistance by including: (a) the carbon black in the adequate amount so as to satisfy the thermal-fixing properties of the toner; and (b) the magnetic powder having a low specific resistance in the relatively large amount in connection with the conductive magnetic toner.

Any or all magnetic powders having the specific resistance of not more than $1\times10^6$ Ω.cm can be employed in the present invention.

In the present invention, the specific resistance can be measured as follows: At first, the magnetic powder 5 is put into the inner cylinder 2 (made of polytetrafluoroethylene) in the measuring apparatus as shown in FIG. 1. The inner cylinder 2 is mounted on the base 3 made of polytetrafluoroethylene. After the load of 200 g/cm$^2$ is exerted thereon, the thickness of the magnetic powder layer placed inside of the inner cylinder 2. Then, when the dc voltage (100 V/cm) is exerted between the upper electrode 1 (Cu-Zn alloy) and the main electrode 4 (Cu-Zn alloy) (cross section: 1.00 cm$^2$), the current thereof is measured. The specific resistance is calculated by the following equation:

$$\rho = R \times S / t$$

ρspecific resistance (Ω.cm),
R: measured resistance value (Ω)
(impressed voltage / current)
S: cross section of the main electrode (cm$^2$)
t: thickness of the magnetic powder layer (cm)

As the magnetic powder, magnetite, ferrite, or the like, which has crystallographically a spinel, perovskite, hexagonal, garnet, orthoferrite structure can be employed in the present invention. More particularly, the magnetic powder is a sintered compact of iron(III) oxide (ferric oxide) or an oxide of nickel, zinc, manganese, magnesium, copper, lithium, barium, vanadium, chromium, calcium, or the like. More concretely, the magnetic powder such as "Magnetite KBI-20V", or "Magnetite KBC-100" produced by Kanto Denka Kogyo Co., Ltd. can be employed.

If the specific resistance of the magnetic powder is more than $1\times10^6$ Ω.cm, the internal resistance of the conductive magnetic toner is increased, which causes increase in the fog density and reduction of the image density in the low-developing potential system.

In addition, if the conductive magnetic toner includes the magnetic powder in the amount of less than 40% by weight, the magnetically constraining force of the conductive magnetic toner to the developing roller is lowered. For this reason, the toner-feeding properties become poor and toner scattering is occurred. On the other hand, if the conductive magnetic toner includes the magnetic powder in the amount of more than 60% by weight, the magnetic powder is scattered with difficulty due to the poor melt-kneading properties during the manufacturing steps of the conductive magnetic toner, and the thermal-fixing properties of the image is deteriorated.

The carbon black employed in the present invention, which is manufactured by a furnace method, a channel method, or the like, has the specific surface area of 800 m$^2$/g through 1500 m$^2$/g and the DBP oil absorption of not less than 200 cc/100 g. The specific surface area is computed by BET equation using $N_2$ gas adsorption. The value of the DBP oil absorption is equal to the amount of DBP measured by an oil-absorption measuring apparatus which is required to fill in the space of the carbon blacks. In the case where the specific surface area is less than 800 m$^2$/g or the DBP oil absorption is less than 200 cc/100 g, the structure of the carbon blacks is not adequate. For this reason, the conductive magnetic toner having a low resistance according to the present invention cannot be obtained.

On the other hand, if the specific surface area is more than 1500 m$^2$/g, a fog density is liable to occur since the dispersion properties of the carbon black to the binder resin are not adequate. As the carbon black according to the present invention, for example, "Ketjen Black E. C." produced by Lion Akzo Co., Ltd , "Black Pearls 2000" produced by Cabot Corporation, or the like can be employed. In the present invention, if the amount of carbon black is not more than 8% by weight in the conductive magnetic toner, then the conductive properties will not be adequate. On the other hand, if the amount of carbon black is not less than 15% by weight in the conductive magnetic toner, then the thermal-fixing properties are not adequate since it is difficult that the carbon black is dispersed and kneaded during the manufacturing steps of the conductive magnetic toner, and the molten viscosity of the toner is increased.

The conductive magnetic toner according to the present invention is obtained by the following successive steps of: kneading magnetic powder, carbon black, a binder resin, and additives by a melt-kneading machine such as a hot roll, a kneader, an extruder, or the like; pulverizing the kneaded mixture by a mill; and classifying the pulverized mixture to obtain a conductive magnetic toner having an average particle size of 4 μm to 20 μm. In addition, the conductive materials such as carbon black and the like may be fixed on the surfaces of the toner particles in order to afford the uniform conductive property to the surface of the toner particles after the classifying step described above. Furthermore, the additives such as silica and the like may be fixed to the surface of the toner particles so as to improve the fluidity of the toner.

In order to fix the carbon blacks to the toner particles, a conventional mixer such as turbin type mixer, or a high-speed mixer ("Henschell Mixer", produced by Mitsui Miike Engineering Co., Ltd.) can be employed. Furthermore, the carbon blacks may be fixed tightly to the surfaces of the toner particles using a surface reformer such as "Nara Hybridization System", produced by Nara Machinery Co., Ltd., "Ang Mill", produced by Hosokawa Micron Corporation, or the like.

A suitable binder resin for the conductive magnetic toner according to the present invention may include a thermoplastic resin selected from the group consisting of monomers such as polystyrene, polyethylene, polypropylene, a vinyl resin, polyacrylate, polymethacrylate, polyvinylidene chloride, polyacrylonitrile, polyether, polycarbonate, thermoplastic polyester, thermoplastic epoxy resin, and a cellulose resin, and a copolymer resin of the monomers listed above; and a thermosetting resin such as a modified acrylate resin, phenol resin, melamine resin, urea resin, or the like.

In addition, various additives may be added to the conductive magnetic toner of the present invention as necessary. Examples of the additives include charge control agents such as metal monoazo dyes, nigrosine dye, or the like; a coloring agent excluding carbon black, or the like; and a fixing auxiliary, or the like.

EXAMPLES

The present invention will be explained in detail hereinbelow with reference to examples.

| Example 1 | |
|---|---|
| a) Epoxy resin ("Epicoat 1004", produced by Yuka Shell | 48% by weight |

-continued

| Example 1 | |
|---|---|
| Epoxy KK) | |
| b) Polypropylene ("VISCOL 550P", produced by Sanyo Chemical Industries, Ltd.) | 2% by weight |
| c) Magnetic powder ("KBI-20V", produced by Kanto Denka Kogyo Co., Ltd., Specific resistance: $8.7 \times 10^4$ Ω · cm) | 40% by weight |
| d) Carbon black ("Ketjen Black E. C.", produced by Lion Akzo Co., Ltd., Specific surface area: 1000 $m^2/g$, DBP oil absorption: 340 cc/100 g) | 10% by weight |

The mixture of the composition listed above was heat-melted and kneaded by means of a biaxial kneading machine. The kneaded mixture was cooled and pulverized using a jet mill. The pulverized mixture was classified by an air classifier to obtain a conductive magnetic toner according to the present invention having an average particle size of 10 μm.

The specific resistance of the obtained conductive magnetic toner was measured, thereby the conductive magnetic toner had the specific resistance of $4.2 \times 10^4$ 106 .cm.

| Example 2 | |
|---|---|
| a) Epoxy resin ("Epicoat 1004", produced by Yuka Shell Epoxy KK) | 48% by weight |
| b) Polypropylene ("VISCOL 550P", produced by Sanyo Chemical Industries, Ltd.) | 2% by weight |
| c) Magnetic powder ("KBI-20V", produced by Kanto Denka Kogyo Co., Ltd., Specific resistance: $8.7 \times 10^4$ Ω · cm) | 40% by weight |
| d) Carbon black ("Ketjen Black E. C."; produced by Lion Akzo Co., Ltd., Specific surface area: 1000 $m^2/g$, DBP oil absorption: 340 cc/100 g) | 10% by weight |

The mixture of the composition listed above was heat-melted and kneaded by means of a biaxial kneading machine. The kneaded mixture was cooled and pulverized using a jet mill. The pulverized mixture was classified by an air classifier to obtain toner particles having an average particle size of 10 μm.

The specific resistance of the toner particles was measured, thereby the toner particles had the specific resistance of $4.2 \times 10^4$ Ω.cm.

The toner particles obtained above of 100 parts by weight and carbon black ("# 40", produced by Mitsubishi Chemical Industry, Co., Ltd.) of 0.8 parts by weight were mixed by means of a mixer, thus obtaining a conductive magnetic toner according to the present invention having the carbon black fixed on the surfaces of the toner particles.

The specific resistance of the conductive magnetic toner was measured, thereby the conductive magnetic toner had the specific resistance of $1.8 \times 10^2$ Ω.cm.

| Example 3 | |
|---|---|
| a) Epoxy resin ("Epicoat 1004", produced by Yuka Shell Epoxy KK) | 48% by weight |
| b) Polypropylene | 2% by weight |

-continued

| Example 3 | |
|---|---|
| ("VISCOL 550P", produced by Sanyo Chemical Industries, Ltd.) | |
| c) Magnetic powder ("KBC-100", produced by Kanto Electric Chemical Industrial Co., Ltd., Specific resistance: $1.9 \times 10^5$ Ω · cm) | 40% by weight |
| d) Carbon black ("Ketjen Black E. C.", produced by Lion Akzo Co., Ltd., Specific surface area: 1000 $m^2/g$, DBP oil absorption: 340 cc/100 g) | 10% by weight |

The mixture of the composition listed above was heat-melted and kneaded by means of a biaxial kneading machine. The kneaded mixture was cooled and pulverized using a jet mill. The pulverized mixture was classified by an air classifier to obtain toner particles having an average particle size of 10 μm.

The specific resistance of the toner particles was measured, thereby the toner particles had the specific resistance of $8.5 \times 10^4$ Ω.cm.

The toner particles obtained above of 100 parts by weight and carbon black ("# 40", produced by Mitsubishi Chemical Industry, Co., Ltd.) of 0.8 parts by weight were mixed by means of a mixer, thus obtaining a conductive magnetic toner according to the present invention having the carbon black fixed on the surfaces of the toner particles.

The specific resistance of the conductive magnetic toner was measured, thereby the conductive magnetic toner had the specific resistance of $3.4 \times 10^2$ Ω.cm.

| Comparative Example 1 | |
|---|---|
| a) Epoxy resin ("Epicoat 1004", produced by Yuka Shell Epoxy KK) | 48% by weight |
| b) Polypropylene ("VISCOL 550P", produced by Sanyo Chemical Industries, Ltd.) | 2% by weight |
| c) Magnetic powder ("EPT-500", produced by Toda Kogyo Corp., Specific resistance: $1.4 \times 10^7$ Ω · cm) | 40% by weight |
| d) Carbon black ("Ketjen black EC", produced by Lion Akzo Co., Ltd., Specific surface area: 1000 $m^2/g$, DBP oil absorption: 340 cc/100 g) | 10% by weight |

The mixture of the composition listed above was heat-melted and kneaded by means of a biaxial kneading machine. The kneaded mixture was cooled and pulverized using a jet mill. The pulverized mixture was classified by an air classifier to obtain toner particles having an average particle size of 10 μm.

The specific resistance of the toner particles was measured, thereby the toner particles had the specific resistance of $2.1 \times 10^6$ Ω.cm.

The toner particles obtained above of 100 parts by weight and carbon black ("# 40", produced by Mitsubishi Chemical Industry, Co , Ltd.) of 0.8 parts by weight were mixed by means of a mixer, thus obtaining a comparative conductive magnetic toner having the carbon black fixed on the surfaces of the toner particles.

The specific resistance of the comparative conductive magnetic toner was measured, thereby the conductive magnetic toner had the specific resistance of $2.7 \times 10^4$ Ω.cm.

Comparative Example 2

The same toner particles obtained as described in Comparative Example 1 of 100 parts by weight and carbon black ("# 40", produced by Mitsubishi Chemical Industry, Co., Ltd.) of 2.0 parts by weight were mixed by means of a mixer, thus obtaining a comparative conductive magnetic toner having the carbon black fixed on the surfaces of the toner particles.

The specific resistance of the comparative conductive magnetic toner was measured, thereby the conductive magnetic toner had the specific resistance of $7.2\times10^2$ Ω.cm.

Comparative Example 3

After the same toner particles obtained as described in Comparative Example 1 of 100 parts by weight and carbon black ("Ketjen Black E. C.", produced by Lion Akzo, Co., Ltd.) of 2.0 parts by weight were mixed by means of a mixer, the mixture was put in a surface reformer ("Nara Hybridization System", produced by Nara Machinery Co., Ltd.) and aftertreated so as to apply an impact force to the mixture in air, thus obtaining a comparative conductive magnetic toner having the carbon black fixed on the surfaces of the toner particles.

The specific resistance of the comparative conductive magnetic toner was measured, thereby the conductive magnetic toner had the specific resistance of $4.3\times10^3$ Ω.cm.

| Comparative Example 4 | | |
|---|---|---|
| a) | Epoxy resin ("Epicoat 1004", produced by Yuka Shell Epoxy KK) | 48% by weight |
| b) | Polypropylene ("VISCOL 550P", produced by Sanyo Chemical Industries, Ltd.) | 2% by weight |
| c) | Magnetic powder ("KBI-20V", produced by Kanto Denka Kogyo Co., Ltd., Intrinsic resistivity: $8.7\times10^4$ Ω · cm) | 40% by weight |
| d) | Carbon black ("#40", produced by Mitsubishi Chemical Industry Co., Ltd., Specific surface area: 135 $m^2/g$, DBP oil absorption: 110 cc/100 g) | 10% by weight |

The mixture of the composition listed above was heat-melted and kneaded by means of a biaxial kneading machine. The kneaded mixture was cooled and pulverized using a jet mill. The pulverized mixture was classified by an air classifier to obtain toner particles having an average particle size of 10 μm.

The specific resistance of the toner particles was measured, thereby the toner particles had the specific resistance of $4.3\times10^8$ μcm.

The toner particles obtained above of 100 parts by weight and carbon black ("# 40", produced by Mitsubishi Chemical Industry, Co., Ltd.) of 0.8 parts by weight were mixed by means of a mixer, thus obtaining a comparative conductive magnetic toner having the carbon black fixed on the surfaces of the toner particles.

The specific resistance of the comparative conductive magnetic toner was measured, thereby the conductive magnetic toner had the specific resistance of $6.2\times10^6$ Ω.cm.

The conductive magnetic toners according to Examples 1 to 3 and the comparative conductive magnetic toners according to Comparative Examples 1 to 4 were tested using a test copy machine of the low-developing electric potential (150 V) having selenium photoconductor.

The resulted image density and the fog density of each of the conductive magnetic toners and the comparative conductive magnetic toners are shown in Table 1.

The values of the image density described in Table 1 were measured so that an adhesive tape adhered to the image on the photoconductor was peeled and then the peeled tape adhered on a white paper was measured by measurements Macbeth RD914. In addition, the values of the fog density described in Table 1 were measured so that an adhesive tape adhered to the photoconductor outside of the image was peeled and then the peeled tape adhered on a white paper was measured by measurements Macbeth RD914.

TABLE 1

| Conductive magnetic toner | Image density | Fog density |
|---|---|---|
| Example 1 | 1.36 | 0.10 |
| Example 2 | 1.41 | 0.10 |
| Example 3 | 1.38 | 0.09 |
| Comparative Example 1 | 1.10 | 0.11 |
| Comparative Example 2 | 1.36 | 0.66 |
| Comparative Example 3 | 1.18 | 0.14 |
| Comparative Example 4 | 0.61 | 0.10 |

As will be apparent from the results shown in Table 1, the conductive magnetic toners of Examples 1 to 3 according to the present invention maintained both good image density and good image quality (less fog density).

The present invention has been described in detail with respect to embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A conductive magnetic toner for use in a low-developing-potential system including a magnetic powder having a specific resistance of not more than $1\times10^6$ Ω.cm in the amount of from 40% by weight to 60% by weight, a carbon black having a specific surface area of 800 $m^2/g$ to 1500 $m^2/g$ and an oil absorption of dibutyl phthalate of not less than 200 cc/100 g in the amount of from 8% by weight to 15% by weight, and a binder resin.

2. A conductive magnetic toner as recited in claim 1, wherein the magnetic powder is a material selected from the group consisting of: magnetite and ferrite, having crystallographically a spinel, perovskite, hexagonal, garnet, orthoferrite structure.

3. A conductive magnetic toner as recited in claim 2, wherein the magnetic powder is a sintered compact of iron(III) oxide, nickel oxide, zinc oxide, manganese oxide, magnesium oxide, copper oxide, lithium oxide, barium oxide, vanadium oxide, and chromium oxide.

4. A conductive magnetic toner as recited in claim 1, further comprising at least one material selected from the group consisting of a charge control agent; a coloring agent; and a fixing auxiliary.

5. A conductive magnetic toner as recited in claim 4, wherein the binder resin is a material selected from the group consisting of a polystyrene monomer, a polyethylene monomer, a polypropylene monomer, a vinyl resin monomer, a polyacrylate monomer, a polymethacrylate monomer, a polyvinylidene chloride monomer, a polyacrylonitrile monomer, a polyether monomer, a polycarbonate monomer, a thermoplastic polyester monomer, a thermoplastic epoxy resin, a cellulose resin monomer; a copolymer resin of the monomers listed above; a modified acrylate resin; phenol resin; melamine resin; and urea resin.

6. A conductive magnetic toner for use in a low-developing-potential system wherein carbon blacks are fixed on the surfaces of toner particles including a magnetic powder having a specific resistance of not more than $1\times10^6$ Ω.cm in the amount of from 40% by weight to 60% by weight, a carbon black having a specific surface area of 800 $m^2/g$ to 1500 $m^2/g$ and an oil absorption of dibutyl phthalate of not less than 200 cc/100 g in the amount of from 8% by weight to 15% by weight, and a binder resin.

7. A conductive magnetic toner as recited in claim 6, wherein the magnetic powder is a material selected from the group consisting of: magnetite and ferrite, having crystallographically a spinel, perovskite, hexagonal, garnet, orthoferrite structure.

8. A conductive magnetic toner as recited in claim 7, wherein the magnetic powder is a sintered compact of iron(III) oxide, nickel oxide, zinc oxide, manganese oxide, magnesium oxide, copper oxide, lithium oxide, barium oxide, vanadium oxide, and chromium oxide.

9. A conductive magnetic toner as recited in claim 6, further comprising at least one material selected from the group consisting of a charge control agent; a coloring agent; and a fixing auxiliary.

10. A conductive magnetic toner as recited in claim 9, wherein the binder resin is a material selected from the group consisting of a polystyrene monomer, a polyethylene monomer, a polypropylene monomer, a vinyl resin monomer, a polyacrylate monomer, a polymethacrylate monomer, a polyvinylidene chloride monomer, a polyacrylonitrile monomer, a polyether monomer, a polycarbonate monomer, a thermoplastic polyester monomer, a thermoplastic epoxy resin, a cellulose resin monomer; a copolymer resin of the monomers listed above; a modified acrylate resin; phenol resin; melamine resin; and urea resin.

* * * * *